US007677321B2

(12) United States Patent
Spray

(10) Patent No.: US 7,677,321 B2
(45) Date of Patent: Mar. 16, 2010

(54) EXPANDABLE TUBULARS FOR USE IN GEOLOGIC STRUCTURES, METHODS FOR EXPANDING TUBULARS, AND METHODS OF MANUFACTURING EXPANDABLE TUBULARS

(75) Inventor: Jeffery A. Spray, Houston, TX (US)

(73) Assignee: Dynamic Tubular Systems, Inc., Houston, TX (US)

( * ) Notice: Subject to any disclaimer, the term of this patent is extended or adjusted under 35 U.S.C. 154(b) by 726 days.

(21) Appl. No.: 10/925,521

(22) Filed: Aug. 25, 2004

(65) Prior Publication Data

US 2005/0109517 A1 May 26, 2005

Related U.S. Application Data

(60) Provisional application No. 60/497,688, filed on Aug. 25, 2003, provisional application No. 60/503,287, filed on Sep. 16, 2003.

(51) Int. Cl.
*E21B 17/00* (2006.01)

(52) U.S. Cl. ..... 166/380; 166/382; 166/207; 166/214; 166/227; 166/242.1

(58) Field of Classification Search ..... 166/380, 166/382, 214, 227, 242.1, 207, 206
See application file for complete search history.

(56) References Cited

U.S. PATENT DOCUMENTS

| | | | | |
|---|---|---|---|---|
| 2,583,316 | A * | 1/1952 | Bannister | 166/387 |
| 3,067,819 | A * | 12/1962 | Gore | 166/387 |
| 3,099,318 | A * | 7/1963 | Miller et al. | 166/227 |
| 5,785,122 | A | 7/1998 | Spray | |
| 6,089,316 | A | 7/2000 | Spray | |
| 6,245,103 | B1 * | 6/2001 | Stinson | 623/1.22 |
| 6,298,914 | B1 | 10/2001 | Spray et al. | |
| 6,503,270 | B1 * | 1/2003 | Richter et al. | 623/1.15 |
| 6,585,753 | B2 * | 7/2003 | Eder et al. | 623/1.15 |
| 6,709,454 | B1 * | 3/2004 | Cox et al. | 623/1.16 |
| 6,719,064 | B2 * | 4/2004 | Price-Smith et al. | 166/387 |
| 2002/0107562 | A1 | 8/2002 | Hart et al. | |
| 2003/0075333 | A1 | 4/2003 | Vercaemer et al. | |
| 2003/0075339 | A1 * | 4/2003 | Gano et al. | 166/380 |
| 2004/0065445 | A1 * | 4/2004 | Abercrombie Simpson et al. | 166/382 |
| 2004/0261994 | A1 * | 12/2004 | Nguyen et al. | 166/278 |
| 2005/0279514 | A1 * | 12/2005 | Metcalfe | 166/382 |

FOREIGN PATENT DOCUMENTS

| | | |
|---|---|---|
| GB | 2053326 | 7/1980 |
| GB | 2053326 A | 2/1981 |

OTHER PUBLICATIONS

English translation of Office Action in Chinese Patent Application No. 200480024633.0, dated Mar. 6, 2009 (5 pages).
English Translation of Office Action in Chinese Patent Application No. 200480024633.0, dated Sep. 5, 2008, 12 pages.

* cited by examiner

*Primary Examiner*—Jennifer H Gay
*Assistant Examiner*—Robert E Fuller
(74) *Attorney, Agent, or Firm*—Osha • Liang LLP

(57) ABSTRACT

Expandable tubulars for use in geologic structures, including methods for expanding the expandable tubulars, and methods of manufacturing them, include the use of an expansive energy storage component, which provides a self-expanding feature for the expandable tubulars.

33 Claims, 7 Drawing Sheets

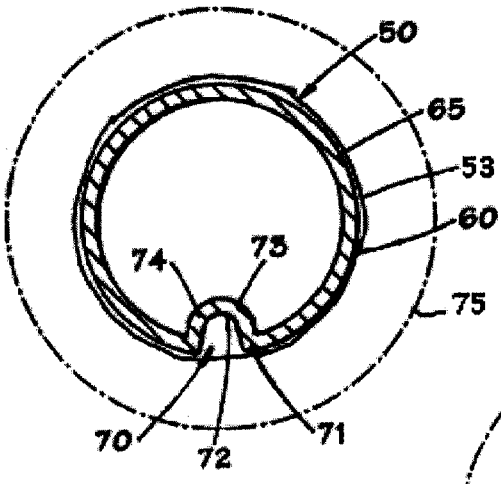
FIG. 2
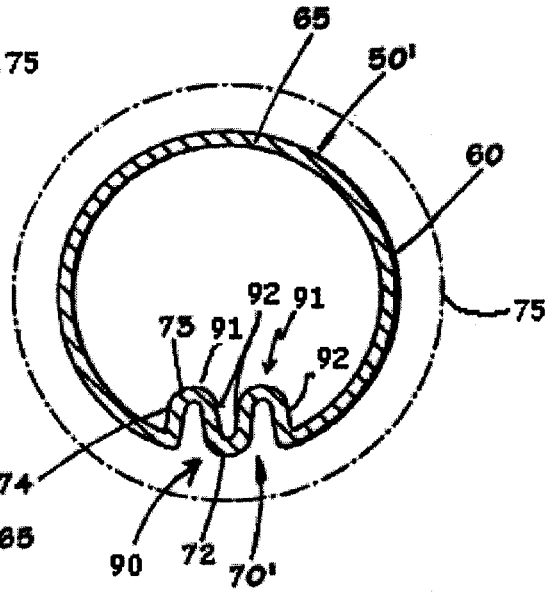
FIG. 3
FIG. 4
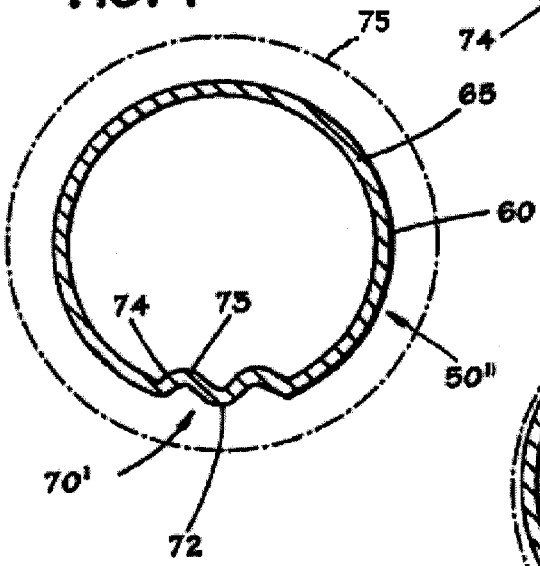
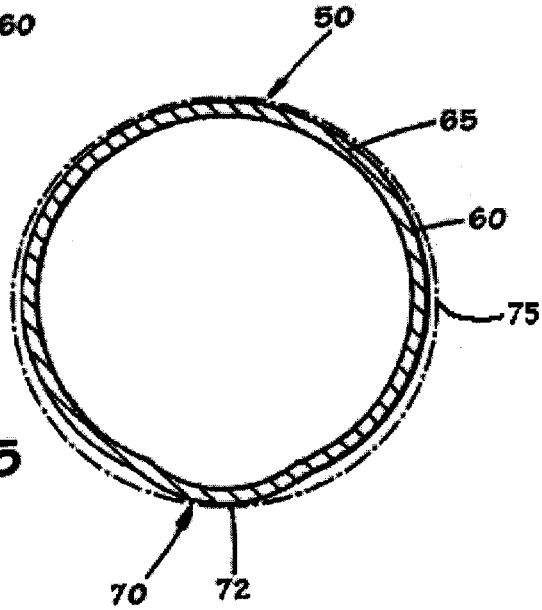
FIG. 5

EXPANDABLE TUBULARS FOR USE IN GEOLOGIC STRUCTURES, METHODS FOR EXPANDING TUBULARS, AND METHODS OF MANUFACTURING EXPANDABLE TUBULARS

RELATED APPLICATIONS

Applicant claims the benefit of the U.S. Provisional Patent Application Serial Nos. 60/497,688 filed Aug. 25, 2003, and 60/503,287 filed Sep. 16, 2003.

BACKGROUND OF THE INVENTION

1. Field of the Invention

The invention relates to: expandable tubulars for use in geologic structures, such as for use in the production of hydrocarbons, such as oil and gas, or oil field tubulars, and for use in similar wells and structures, such as water wells, monitoring and remediation wells, tunnels and pipelines; methods for expanding oil field tubulars and other expandable tubulars; and methods for manufacturing expandable tubulars. Expandable tubulars include, but are not limited to, such products as liners, liner hangers, sand control screens, packers, and isolation sleeves, all of which are generally used in geologic structures, such as in the production of hydrocarbons and are expanded outwardly into contact with either the well bore or the well casing, as well as products for use in similar wells and structures, as previously set forth.

2. Information Incorporated by Reference

Applicant incorporates herein by reference U.S. Pat. Nos. 5,785,122; 6,089,316; and 6,298,914, each entitled "Wire Wrapped Well Screen", and commonly owned by the applicant herein.

3. Description of the Related Art

Drilling and construction of oil and gas wells remains a slow, dangerous, and very expensive process despite a century of continual technological advances. With the costs of some wells approaching 100 million dollars, the primary cause of these high costs occurs due to the need to suspend drilling progress in order to repair geologically-related problem sections in wells.

The major problems of lost-circulation, borehole instability, and well pressure control are still generally rectified only by costly and time-consuming casing and cementing operations. Such conventional sealing processes are required at each problem-instance, often dictating installation of a series of several diametrically descending, or telescopic-casing strings in most wells. Generally, each casing string is installed from the surface to each problem zone and a 10,000 foot deep well often requires 20,000-30,000 feet of tubulars.

Disadvantages of telescoping practices are numerous, including the requirements of excess excavation work and corresponding equipment requirements for over-size rock borings and their over-production of costly waste products. Beginning diameters in excess of 24" are usually required to allow a 5" or less final production string. Large-scale drilling operations currently may require drilling equipment hoist ratings as high as 2,000,000 pounds and consume several acres for drill-site location, with both requirements due largely to various casing needs and operations. Frequently, and despite major expenditures and efforts, the final telescope casing size, or production string, may be too small to economically produce the hydrocarbon resource, resulting in a failed well.

The energy industry has pursued development of alternative, "monobore" well-casing systems in recent years, wherein one size casing is used from the surface to the target zone, normally some 1-7 miles below. Monobore concepts replace each former concentric surface-to-problem-zone casing string installation with discrete-zone placement of an expandable casing. A median casing size of 7⅝" outside-diameter ("OD") would ideally be expanded to approximately conform to a nominal 10" borehole by means of a cold-work, mechanical steel deformation process performed in-situ. The expanded casing assembly must meet certain strength requirements and allow passage of subsequent 7⅝" OD casing strings as drilling deepens and new problem zones are encountered.

The foregoing deforming process inherently requires use of soft steels, which cannot produce many critical mechanical properties required in high-demand environments normal to oil and gas wells. It is believed 60-70% of potential customers cannot consider using current expandables due to fundamentally unsolvable technical issues. The deformed casing provides no sealing effect, and thus, cementing operations are still required.

A variety of downhole expandable tubulars and downhole "tools" are presently in use for oil and gas production. The ultimate success of these new expandable tubulars and/or downhole tools will be dependent upon their ability to comply, or adhere, to the various subsurface geometries against which they are expanded, and their use to create some control over well bore fluid flows. Subsurface conditions continually change over the life of any type of well due to abrasive wear of formation particles, subsidence or various biological, chemical and geo-chemical processes occurring over years. Those expandable tubulars, after having been expanded must substantially retain their compliance throughout their useful life.

True expandable tubular, or device, compliance cannot be accomplished with current, expandable tubulars due initially to the natural tendency of steel materials to "spring back" from their altered states to their natural, or original, form. Spring back is also sometimes referred to as "recovery", "resilience", "elastic recovery", "elastic hysteresis", and/or "dynamic creep". The principle exists in all stages of worked steels, or other metallic materials, until the point of rupture, due to excess deformity. For pre-ruptured tubes, there are different degrees of deformity throughout the thickness of the tube-arc, translating to guaranteed springback, at rates varying according to the severity of arc, corresponding to severity of deformation. Of course, "spring back" is greater if the metallic material, such as steel, has not been deformed beyond the elastic limit of the material.

Current expansion methods and expandable devices are capable only of deforming material according to one vector and assume device-freedom, or no obstructions or additional work requirements such as pressure against well bore rock. Indeed, local expansion essentially ceases upon encountering such a work obstacle; and the expansion can likely never be 100% adherent. Expansion essentially stops upon encountering the obstruction, or rock, and the expandable tubular then shrinks, and an annular space typically always exists with current technologies.

It is primarily localized over-expansion and excess material deformation, abutting the imperfections which are quite common in any well bore or cased hole environment, which create any type of device, or tubular, well bond; however, the expanded device and well formation are not substantially adhered to one another. The problem is compounded with expansion occurring in irregular geometry environs. Since upon final expansion, the device is static, absent its tendency toward recovery, or spring back, and any work imposed on it by the well bore environ, problems may be caused by compliance-voids, or uncontrolled "hot-spots" of high-velocity and high-pressure fluid flows in the well.

The purpose of expandable tubulars is to permit a "solid-tubular", such as a casing, liner-hanger, isolation sleeve, packer and/or sand-control screen to be passed through the smallest diameter casing and/or borehole in a well for the production of hydrocarbons, and then be subsequently expanded against that casing or directly expanded against a larger uncased borehole. An important economic benefit is that the expense and time to install cement or gravel pack envelopes are eliminated, or greatly reduced.

For sand-control screens, the technical benefits begin with improved wellscreen-borehole proximity, as well fluids are less inhibited to enter the screen. Further benefits may include improved access and mechanical effectiveness for removing drilling mud, repairing drill damage, and restoring natural production potential. Additionally, greater functional screen-surface-area is produced which provides more functional fluid-flow area and plugging resistance. Another benefit created by wellscreen expansion is greater internal diameter of the expandable tublular. This allows for placement of larger diameter pumps and other equipment or tooling into the producing areas of a well, which are in use in various available "intelligent well" flow-control hardware, such as pumps, valving and in situ separators.

In general, presently available expandable tubulars, and methods for expanding them, utilize a perforated or slotted basepipe, or original tubular member, which is expanded, or deformed beyond the elastic limit of the material forming the basepipe, or plastically deformed, by forcing an expansion device, such as a pig or a mandrel through the basepipe and expanding and deforming it, or by pulling through, or rotating within the basepipe, tapered wedges or rollers, to again expand and permanently deform the basepipe. It is believed that presently used expandable tubulars have a capability of having their outer diameter expanded by a factor of from 25 to 50 percent, whereas it is believed that an increase of one hundred percent would be desirable. Another disadvantage of presently available expandable tubulars is the reliability of the expansion. Reliability problems stem from the complexity of the devices themselves, wherein several layer-elements are required to act in coordination with each other with some presently known expandable tubulars. Irregularities in borehole conditions, including excess bend severity, swelling induced diameter restrictions, and non-concentricity, may each tend to prevent these coordination requirements.

Another disadvantage of presently used expandable tubulars, relates to their limited collapse resistance. The expansion and permanent deformation of currently available basepipes, inherently results in a progressively thinning outer wall thickness. For collapse resistance, greater wall thickness is required as the diameter of the tubular expandable, or device, increases. Some present products provide for as little as 270 psi collapse resistance at full expansion, while others may provide approximately 1000 psi collapse resistance. The industry preference would be approximately 3500 psi minimum. Thinning of a conventional expandable tubular occurs rapidly as its diameter is increased. It is also well known that high-levels of deformity cause stress-cracking and a variety of metallurgical problems. The deformed-device resistance to collapse forces is lost at a certain rate proportional to the cube of its outside diameter. It is believed that the loss of collapse resistance is accelerated by the use of slotted basepipes, which actually result in substantial areas void of any steel mass. While employing thicker walled basepipes might represent a solution to collapse resistance problem, a robust wall thickness requires significant additional mechanical work in order to be expanded. The additional work is, in turn, believed to be beyond the capabilities of current expansion devices, costs, and competitive field time requirements. Furthermore, an expansion process too robust can create additional void areas in some geology and well materials.

Another disadvantage is general compliance, in that only perfect conditions are addressed conventionally, but very few aspects of downhole geometrical conditions are perfect. This is true, particularly, with regard to roundness, as it is generally a required condition for effectiveness of conventional technologies. Even cased-hole environments exist only as varying degrees of eccentricity or ellipticity, not generally with perfect roundness. Potential uncased borehole geometry is unlimited. It is believed that conventional expandable tubulars cannot be suitably utilized in non-round conditions, as these conditions compound all collapse stresses exponentially to already inversely-cubed-variables found in Timoshenko and similar plates and shells formulae.

A further disadvantage of conventional expandable tubulars is the lack of true-compliance in the form of expansion-energy storage and dynamic adjustment capabilities. Currently, no mechanism has been provided to maximize adherence of an expanded, expandable tubular device due to: the energy dampening effects created through deformity of ductile materials; inefficient energy transfer through multiple layers of some expandable tubulars; and "spring-back" principles inherent to any material phase. Additionally, the expansion and deformation of soft, ductile basepipe materials beyond their elastic/plastic limits may create well-known stress-cracking issues.

A further disadvantage of present, conventional expandable tubulars, is that as the basepipe, or originally utilized tubular member, is deformed outwardly into engagement with the well bore, such outward radial expansion causes the overall length of the tubular member to be shortened. Such shrinkage, along the longitudinal axis of the tubular member, can impede radial expansion when casing between casing "stuck points" and present spacing and connection problems when joining multiple sections of basepipe within a borehole, as axially spaced voids of varying length may be present, dependent upon how much radial expansion of the basepipe has occurred, which results in the undesired axial shortening of the basepipe.

SUMMARY OF THE INVENTION

In general, the present invention is an expandable tubular having at least one energy storage component associated therewith, which upon the expandable tubular expanding from its first unexpanded diameter to a second expanded diameter, the stored energy is released to urge the expanded, expandable tubular into a compliant, or substantially abutting, relationship with the interior of a geologic or a similar structure, such as a well casing or a borehole.

BRIEF DESCRIPTION OF THE DRAWINGS

In the drawings:

FIG. 2 is a cross-sectional view taken along line 2-2 of FIG. 1;

FIG. 3 is a cross-sectional view of another embodiment of an expandable tubular similar to the view of FIG. 2;

FIG. 4 is a cross-sectional view of the embodiment of the expandable tubular of FIG. 3 after it has begun to expand;

FIG. 5 is a cross-sectional view of the embodiment of the expandable tubular of FIG. 2 after it has substantially expanded to its largest diameter;

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

Figure 1:
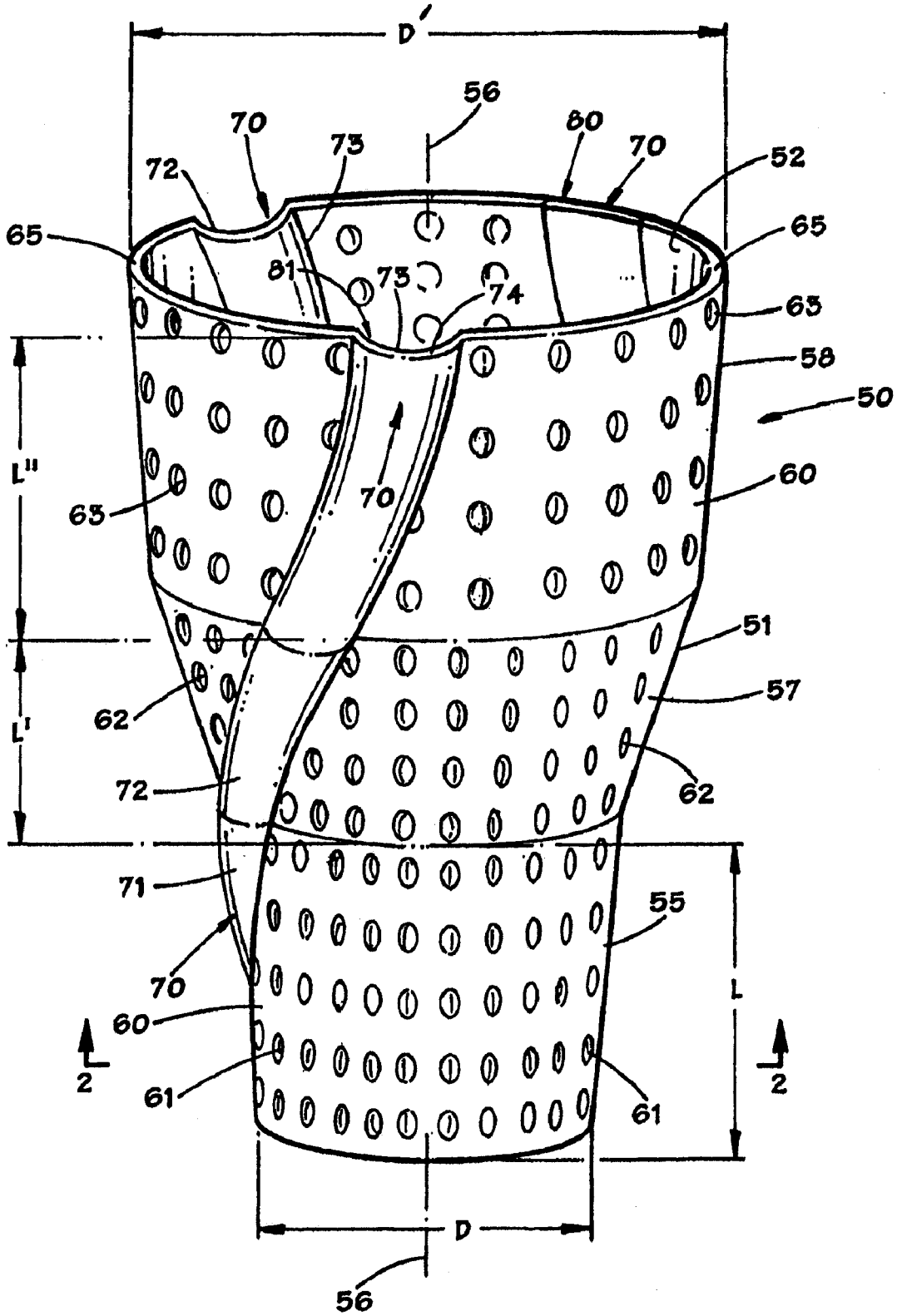
FIG. 1 is a perspective view of an embodiment of an expandable tubular in accordance with the present invention.

With reference to FIG. 1, an embodiment of the present invention is illustrated in connection with expandable tubular 50. By use of the term "expandable tubular", it is intended to include, but not be limited to, generally tubular shaped members for use in geologic structures, such as those intended to be used downhole within a well bore, or borehole, or within a casing of a cased well bore, or borehole, or to generally tubular shaped members for use in similar wells and structures, such as water wells, monitoring and remediation wells, tunnels, and pipelines. Such generally tubular shaped members include, but are not limited to, liners, liner hangers, sand control screens, packers, and isolation sleeves, as are known in the art of the production of hydrocarbons, such as oil and gas, as well as products for use in the similar wells and structures previously set forth. The expandable tubular 50 shown in FIG. 1, in combination with a filter member, as will be hereinafter described in greater detail, might be utilized as a sand control screen, or well screen. The expandable tubular, or tubular, 50, if provided with a solid layer of a plastic, or elastomeric material 53 (FIG. 2), such as a layer of rubber, plastic, or similar elastomeric material, upon the outer surface 51 of tubular 50, becomes an isolation sleeve. Throughout the following description, the same reference numerals are utilized for elements having the same, or similar, function and structure, with primed reference numerals generally denoting different embodiments of the element being described.

Expandable tubular 50 includes a first portion 55 of expandable tubular 50 wherein portion 55 has a first, unexpanded diameter D, with first portion 55 having a length L, measured along the longitudinal axis 56 of tubular 50. A second portion 57 of expandable tubular 50 represents a transitional, or intermediate stage, of expandable tubular 50 having a length L', wherein the second portion 57 is shown in the process of expanding from the unexpanded diameter D to an expanded diameter, which is larger than the first unexpanded diameter D. A third portion 58 of expandable tubular 50 represents the configuration of expandable tubular 50 after it has been expanded, as will be hereinafter described in greater detail, to a desired expanded diameter D'. Thus, FIG. 1 illustrates a section of an expanded tubular 50 as it expands and acquires an increased diameter D'.

Still with reference to FIG. 1, expandable tubular 50 is generally comprised of a conventional expandable basepipe, or generally tubular shaped member, 60 having an outer wall surface 51 and an inner wall surface 52. Basepipe 60 may initially be formed with a plurality of openings, or perforations, 61 formed therein; the perforations 61 initially having a generally oval, or elliptical shape, as viewed in connection with the first portion 55 of expandable tubular 50, when the first portion 55 has the unexpanded diameter D. Upon expansion of basepipe 60 in a conventional manner, as by utilizing a mandrel or pig which is pushed or pulled through basepipe 60. Basepipe 60 passes through the intermediate, or transitional second portion 57, during which it is seen that the oval shaped perforations or openings transition from an oval shape to an intermediate oval, or elliptical shape 62. As basepipe 60 is continued to be expanded and deformed into the configuration shown in connection with third portion 58, having diameter D', the openings or perforations assume a circular shape 63. The change in the shape of the openings 61-63 is generally a result of the expansion of the diameter of basepipe 60 in a radial, outward direction with respect to the longitudinal axis 56 of expanded tubular 50. Similarly, as the expansion occurs, the overall length of the expandable tubular 50, or basepipe 60, will decrease in a direction along the longitudinal axis 56 of expandable tubular 50. Similarly, the thickness of the wall 65 forming basepipe 60 will somewhat decrease, or become thinner, upon expansion to diameter D'.

Still, with reference to FIG. 1, the perforations 61 represented can be heat-treated and quenched with bias toward their enlargement. The overall final mass supplied to the collapse-resistance function of expandable tubular 50 may be amplified if the holes, or perforations, 61 are forged, instead of drilled, since drilling removes material, or mass. The same heat treatment can be used with tubulars having a plurality of slots as hereinafter described.

Alternatively, basepipe 60 may have a plurality of alternating, staggered slots formed therein as is known in the art, and the slots are generally disposed along the longitudinal axis 56 of expanded tubular 50. Upon expansion of that embodiment of basepipe 60 (not shown), the openings or slots, formed in basepipe 60 assume a hexagonal configuration upon expansion of the basepipe 60, as is known in the art. As is conventional, basepipe 60 is expanded or deformed, beyond the elastic limit of the material of which basepipe 60 is manufactured, which is typically steel, having the requisite strength and durability characteristics to function as an expandable tubular in a downhole environment. Alternatively, any other material having the requisite strength, durability, and flexibility characteristic capable of functioning in the manner previously described in a downhole environment may also be utilized to manufacture basepipe 60.

Still with reference to FIG. 1, expandable tubular 50 also includes at least one, and preferably a plurality, of springs, or energy storage components 70, as will hereinafter be described in greater detail. The spring, or energy storage component, 70 serves the purpose of storing energy, or expansive energy, therein when the basepipe has its first unexpanded diameter D, and the energy storage component 70 releases at least a portion, and preferably a substantial portion, of its stored energy, preferably continuously over the period of time that the expandable tubular 50 is disposed downhole in its desired location within the casing or borehole 75 (FIG. 2). The release of the stored energy tends to cause the outer wall surface 51 of expandable tubular 50 to be urged, or biased, outwardly, in a radial direction, substantially perpendicular to the longitudinal axis 56 of expandable tubular 50. This outwardly extending, biasing force thus tends to continuously bias, or force, the expandable tubular 50 when it has its desired expanded diameter D' to be urged against the interior of the casing or borehole 75 to achieve a substantially improved compliant, or abutting, relationship with the interior of the casing, or borehole.

Energy storage component 70 in the embodiment illustrated in FIGS. 1 and 2 may initially comprise a groove, channel, or indentation 71 associated with the basepipe 60. The indentation 71 may be a separate component, or spring like groove, disposed between adjacent sections of basepipe 60, and the energy storage component 70, or groove 71, may be fixedly secured to the adjacent sections of basepipe 50, as by a welding process. Alternatively, the energy storage component 70, or indentation, 71 may be formed integral with basepipe 60, as by forming it with a roller, or any other suitable manufacturing technique. The energy storage component 70, or groove 71, generally extends in a direction along the longitudinal axis 56 of expandable tubular 50, and as illustrated in FIG. 1, energy storage component 70 generally wraps around basepipe 60 in a helical, or spiral direction and manner.

As seen in FIG. 2, groove 71 in the first portion 55 of expandable tubular 50 may be initially formed to have a grooved configuration wherein the outer surface 72 of the wall 74 of groove 71 is convex with respect to the outer wall surface 51 of basepipe 60 and the inner wall 73 has a concave configuration with respect to the inner wall surface 52 of basepipe 60. The cross-sectional configuration of the energy storage component 70, or groove 71, may typically have a semi-circular, or other, configuration with the outer wall surface 72 of groove 71 being convex with respect to the outer wall surface 51 of basepipe 60. Energy, or expansive energy, is then stored within energy storage component 70, or the wall 74 of groove 71, by forcing, or compressing, wall 74 radially, inwardly along the longitudinal axis 56 of basepipe 60. As seen in FIG. 2, by compressing, or otherwise forcing wall 74 of groove 71 inwardly, groove 71 is disposed with outer wall 72 being concave with respect to the outer wall surface 51 of basepipe 60 and is disposed in a convex relationship with respect to the interior wall surface 52 of basepipe 60. The energy is stored within energy storage component 70, provided that wall 74 is not deformed beyond its elastic limit to assume the inwardly disposed relationship shown in FIG. 2. In other words, the wall 74, which forms groove, indentation, or channel 71, serves as a spring, which is now compressed and stores energy therein. Any suitable restraining device, such as an exterior liner, at least one, and preferably a plurality of, bands or straps (not shown), disposed upon the outer wall surface 51 of the first portion 55 of expandable tubular 50 may serve to maintain groove 71, or energy storage component 70, in its compressed state, wherein the desired energy is stored therein. Alternatively, tack welds, solder, epoxy; removable, etchable, or shearable metallic or plastic bands, coatings, or straps; or a chemical adhesive may be utilized to restrain, or maintain, energy storage component 70 in its compressed, energy storing disposition. Upon the release of the compressive force which acts upon energy storage component 70, such as by dissolving, shearing, etching, removing, or rupturing, the exterior liner, or straps, or by dissolving the welds or chemical adhesive, etc., the wall 74 of groove 71 will begin to spring outwardly toward the interior of the casing or borehole 75. At that time, the wall 74 may move outwardly until it is substantially co-planar with the inner and outer wall surfaces 51, 52 of basepipe 60, as shown at 80 in FIG. 1, and then wall 74 subsequently springs outwardly so that the outer wall surface 72 of wall 74 has a configuration illustrated at 81 in FIG. 1 in connection with the third portion 58 of expandable tubular 50. The energy storage component 70 then functions as a spring, or self-expanding spring to force, or bias, the outer wall surface 51 of the expanded third portion 58 of expandable tubular 50 outwardly into an abutting, compliant relationship with the interior of the casing or borehole 75, as shown in FIG. 5.

The force, or energy, stored within energy storage component, or spring 70, may also be released simultaneously with the expansion of basepipes in a conventional manner, as by pushing or pulling a pig or mandrel through basepipe 60. The expansion of basepipe 60 could in turn release whatever restraining device or mechanism is being utilized to maintain the wall 74 of energy storage component 70, or groove 71, in its initial compressed configuration. Thus, were straps or an exterior liner (not shown) to be disposed about the outer wall surface 51 of basepipe 60, the expansion of basepipe 60 can initially cause the rupture or opening of the straps and/or liner thus releasing the spring energy stored within the energy storage component 70.

Alternatively, it should be noted that the foregoing described energy storage components 70, and those energy storage components to be hereinafter described, my also be used alone in a basepipe 60, without the openings, or perforations, 61 or staggered slots. The desired expansion of the expandable tubular may thus be achieved solely from the use of the energy storage components of the present invention, which provide a self-expanding expandable tubular.

Still with reference to FIG. 2, basepipe 60 is disposed within a borehole 75, and its run-in-hole, unexpanded, or smaller, diameter is illustrated, which may be a 4" diameter tube, with at least one energy storage component, or high-tensile arching spring element, or groove, 71 fixed about a helix. The natural form of groove 71 can be concave, as shown and described in connection with FIG. 2, but it may also initially be convex, since in its final expanded, working form, shown in FIG. 5, it is convex. Furthermore, forcing an opposite arching position, or configuration, at the time of fabrication is an additional method of supplying greater mass-energy and self-expanding bias to basepipe 60.

It should be apparent to one of ordinary skill in the art that energy storage component 70 could have other configurations, as well as other mechanisms could be used to provide the desired biasing energy. For example, instead of a groove 71 having a semi-circular cross-sectional configuration providing the energy storage component, energy storage component 70' could be a portion, or portions, of wall 74 formed in a cross-sectional configuration having a serpentine or Z-shaped configuration as shown in FIG. 3. The serpentine configuration of FIG. 3, as compared with a Z-shaped (not shown) spring 70', has more rounded connector portions 91 where the legs 92 of spring 70' are connected to each other. The serpentine, or Z-shaped wall surface 90 functions as a spring 70' which may be compressed to store energy. The Z-shaped energy storage component 70' may be disposed substantially parallel to the longitudinal axis 56 of expandable tubular 50, or may be spirally or helically disposed with respect to the longitudinal axis 56, in the manner that groove 71 is shown in FIG. 1. Energy storage component 70', having a serpentine or Z-shaped cross-sectional configuration, functions as a spring, which may be compressed to store the desired energy in the manner previously described.

With reference to FIG. 4, a partial cross-sectional view of expandable tubular 50' of FIG. 3 is shown in the transitional phase, or intermediate stage 57 (FIG. 1). This particular type of spring element, or energy storage component, 70' is transitioning to its serpentine, or Z-shaped form during transformation from concave to its actuated convex form. With reference to FIG. 5, a partial cross-sectional view of basepipe 60, or expandable tubular 50 of the final expanded portion 58' of FIG. 1, but only illustrating the shape 81 (FIG. 1) of energy storage component 70, is shown. The convex position, or configuration, of energy storage component 70, in an exaggerated relationship, for purposes of illustration, of the elastic component, or groove 71, is shown with the outer wall surface 72 of wall 74 of groove 71, tangentially in contact with borehole 75.

The outwardly biased spring component, or energy storage component, 70, 70' and those to be hereinafter described, is performing three functions. First, it is the elastic contact point, where the energy of the expandable tubular is manifested, proactively determining certain geometry and behavior in the borehole 75. Secondly, spring 70 is providing compliance-type pressure, or mass-energy equivalent collapse-resistant bias in a manner circumferentially. Lastly, energy storage component, or spring 70, 70' provides the greater final desired diameter D' of basepipe 60.

In a 200% expanded scheme, such as a 4" OD to 8" OD basepipe 60 with robust ½" or greater wall-thickness, there is allowed substitution of the spring element 70 with higher-tensile materials, such as outwardly radially-sliding/radially-pushed spring schemes. The energy storage components, or springs 70 in this embodiment, as will hereinafter be discussed, resemble hairpin geometry and are relatively thin-walled members. Small-diameter, relatively thick-walled cylinders, or partial shell structural principles may be utilized as suppliers of elastic strength. Transforming such cylinders into ½"-shell, ¾"-shell or other proportions, and adding short panels, or legs, to create the hairpin form, allows for the manipulation of appropriate ex-situ compression and ultimate downhole compliant elasticity as the elements interact. Of course, many such small spring members can be layered.

Figure 6:
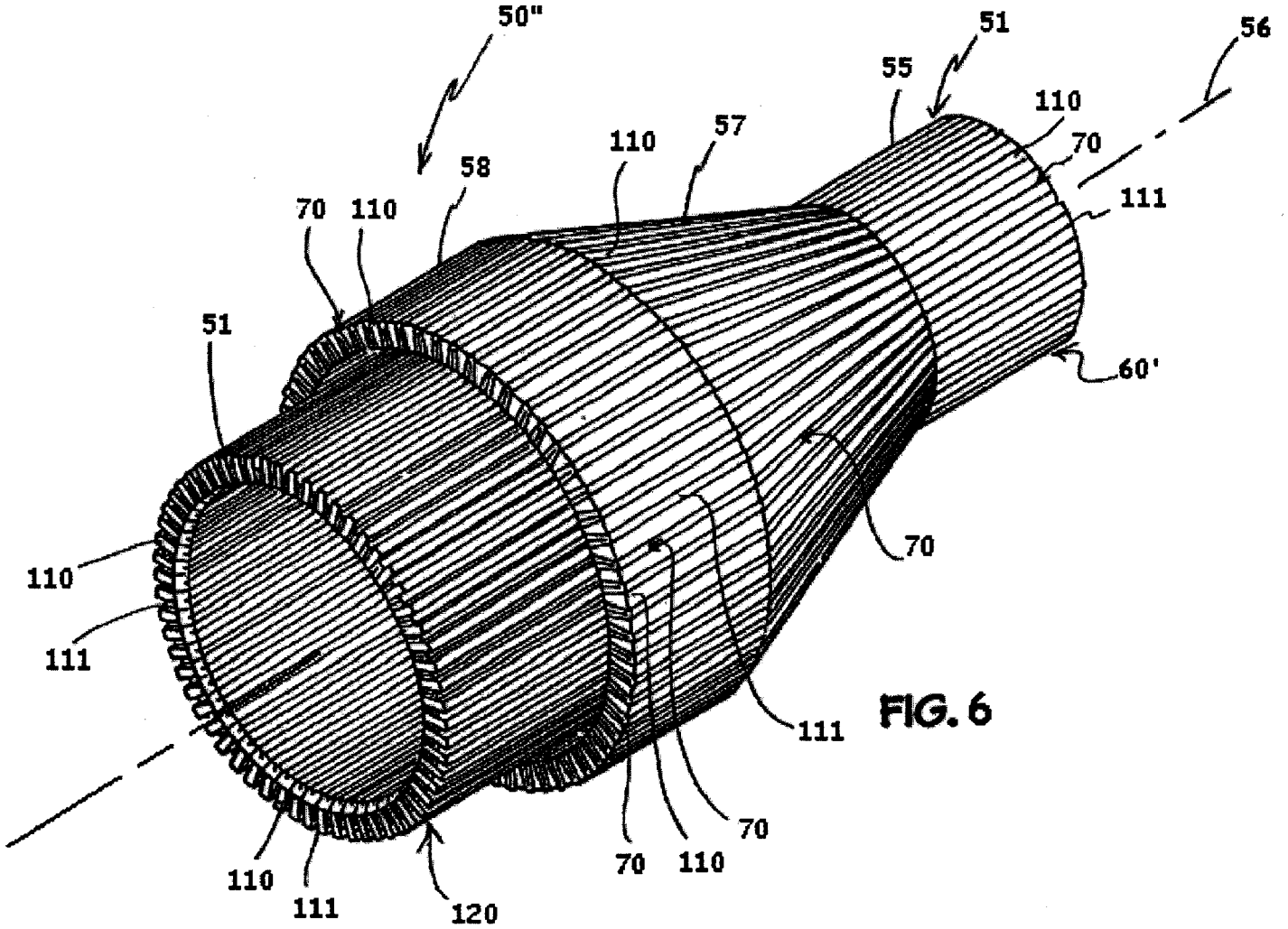
FIG. 6 is a perspective view of another embodiment of an expandable tubular in accordance with the present invention.

With reference to FIG. 6, another embodiment of expandable tubular 50" is illustrated, wherein expandable tubular 50" is shown with the three portions 55, 57, 58 or stages of expansion, illustrated in connection with the expandable tubular 50 of FIG. 1. Portion, or stage, 55 has the unexpanded diameter D, and portion 58 has the fully expanded portion, or expanded diameter D'. Expandable tubular 50" has at least one, and preferably a plurality of, energy storage components 70 radially disposed about, and substantially parallel to, the longitudinal axis 56 of expandable tubular 50". The energy storage components 70 are disposed between axially extending, substantially rigid members, wall members, or bar support members, 110. The energy storage components 70 may be in the form of elongated, generally V-shaped, or generally U-shaped spring members 111, which are initially compressed and disposed between the wall members 110 to form a basepipe 60' as shown in portion 55. The expansion of portion 55 of expandable tubular 50" is initially restrained in any suitable manner, as previously described in connection with expandable tubulars 50, 50'. As the restraining force upon energy storage components 70, or springs 111, is released, the springs 111 which are initially disposed in a spaced relationship from the outer wall surface 51 of basepipe 60, expand and slide radially outwardly, until they are disposed in the configuration illustrated in portion 58 of expandable tubular 50" of FIG. 6. For illustration purposes, a portion 120 of expandable tubular 50' is shown toward the left side of FIG. 6 and illustrates springs 111 being inwardly spaced from the outer surface 51 of expandable tubular 50", with each of the spring members 111 being preferably being disposed between elongate support members 110. In this regard, portion 120 of expandable tubular 50" is more representative of the configuration of expandable tubular 50" while it is in the transitional state, or portion 57 shown in FIG. 6.

Figure 7:
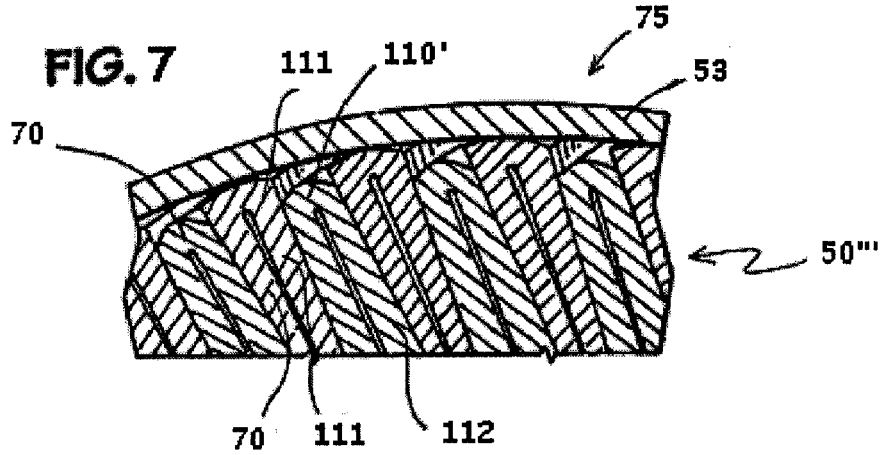
FIG. 7 is a exploded view of a portion of another embodiment of an expandable tubular in accordance with the present invention.

FIG. 7 is an exploded view of another embodiment of an expandable tubular 50'" within a borehole 75, similar to the expandable tubular 50" of FIG. 6. The expandable tubular 50'" is illustrated in the fully expanded configuration, of portion, or stage, 58 of FIG. 6 wherein elongate, substantially, or generally, V-shaped, or U-shaped, spring members 111 are disposed between elongate support members 110'. Bar, or support member 110', instead of being relatively rigid as are support members 110 of the embodiment of FIG. 6, are rather also formed as energy storage components 70, or elongate, substantially V or U-shaped spring members 112. It is believed that this expandable tubular 50'" may provide more finely detailed compliance levels by interaction of the energy storage components 70, or spring members 111, 112. In this embodiment of expandable tubular 50'", a sheathing, liner, or cladding 53 is preferably utilized. The liner of member 53 may either be a sand-screening membrane or a solid casing layer, dependant upon the intended use of expandable tubular 50'".

Figure 8:
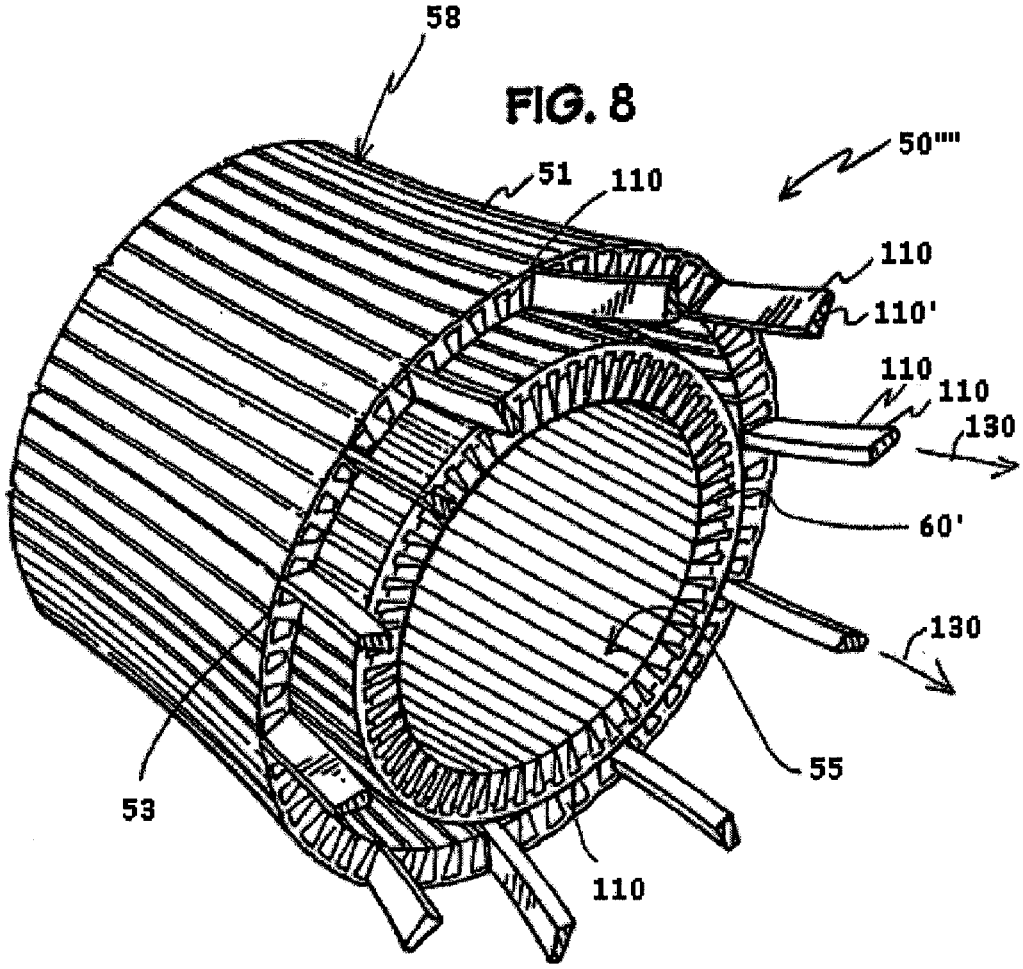
FIG. 8 is a perspective view of another embodiment of an expandable tubular in accordance with the present invention.

With reference to FIG. 8, another embodiment of an expandable tubular 50"" is shown. In its unexpanded configuration, or portion 55, as well as in its expanded configuration or portion 58. The construction of this expandable tubular may be the same, or similar to those previously described in connection with FIGS. 6 and 7, as well as subsequent embodiments of expandable tubulars to be hereinafter described. If desired, the principles of post-tensioning may be utilized in connection with the expandable tubular, whereby additional outward bias, or outward self-expansion of the outer wall surface 51 of basepipe 60' may be achieved by pulling, or applying a tension force in the direction shown by arrows 130 upon elongate members 10, or alternatively, elongate members 10'. The tension, or pulling force, is applied from an anchored point of greater diameter or by literal post-tensioning practices where an outward arching bias is created by placing the tension members underneath other members. For illustrative purposes, FIG. 8 only illustrates a few elongate members 110 under tension; however, preferably all of the elongate members 110 would be tensioned. As previously described, if desired, a sheathing, coating, or cladding 53 may also be utilized.

Figure 9:
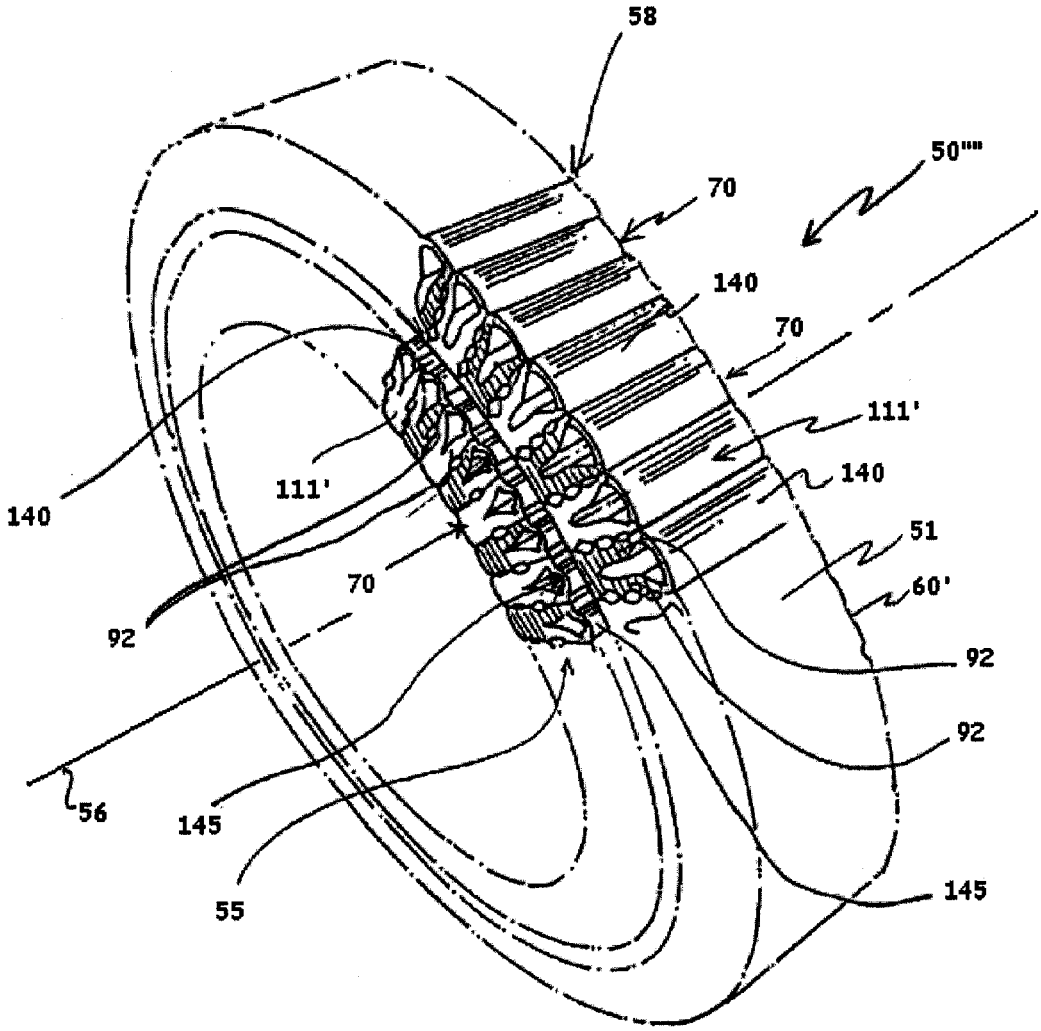
FIG. 9 is a perspective view of another embodiment of an expandable tubular in accordance with the present invention.

With reference to FIG. 9, another embodiment of an expandable tubular 50"" is illustrated in its run-in or unexpanded stage 55, and in its expanded, substantially full diameter D' stage 58. The outer wall surface 51 of basepipe 60 is formed by a plurality of energy storage components 70, which extend substantially parallel to the longitudinal 56 of basepipe 60' of expandable tubular 50"". Alternatively, at least some portion of the outer wall surface 51 of basepipe 60' is formed by some energy storage components 70, and the other portion may be formed by some other type of element, such as wall members 110, previously described. Preferably, substantially all of the outer wall surface 51 of basepipe 60 is formed by a plurality of energy storage components 70.

Still with reference to FIG. 9, at least some of the energy storage components 70, and preferably a substantial number, if not all, of the energy storage components 70 are generally U-shaped or V-shaped elongate spring members 111', each of which is generally disposed substantially parallel to the longitudinal axis 56 of basepipe 60'. Each elongate spring member 111' preferably includes an elongate curved wall surface 140, which is disposed in a direction which lies substantially parallel to the longitudinal axis 56 of basepipe 60'. Wall surface 140 bridges the space between the legs 92 of spring members 111'. Spring members 111', which include curved wall surfaces 140, may be considered to be a cylindrical surface supported by the walls, or legs 92, which structure is commonly called a "vault", as seen in FIG. 9. Curved wall surfaces 140 generally behave much like a series of parallel arches. The curved wall surfaces 140 may be secured to the legs 92 of spring members 111' in any suitable manner, provided the resulting structure is able to function to permit the expandable tubular 50"" to expand outwardly upon release of a restraining force, as previously described. Preferably, when an expandable tubular is made of a suitable steel, or other metallic material, curved wall members 140 may be secured to legs 92 as by welding. If a plastic material is utilized, the curved wall surface, or wall members, 140 may be secured to legs 92 as by an adhesive, or epoxy, other similar connection strategy, or any suitable connection technique. Although two legs 92 are shown, a lesser or greater number of legs 92 may be used in spring members 111'.

Expandable tubular 50"" may be assembled by associating a plurality of energy storage components 70, or springs 111' in the expanded stage 58, and then the expandable tubular 50"" may be radially compressed to assume the run-in configuration 55. If expandable tubular 50"" is compressed, legs 92 of spring members 111' move toward each other and the curved wall surfaces, or wall members, 140 are forced to move outwardly in a radial direction away from the longitudinal axis 56 of basepipe 60, as shown at 145. The compressed expandable tubular 50"" is then restrained in the configuration of the compressed, or reduced diameter stage or portion, 55, as previously described in connection with other embodiments of expandable tubulars of the present invention. After the expandable tubular 50"" is disposed in the geologic structure, or borehole 75, for example, the restraining force may be removed as previously described, whereby the legs 92 of each spring members 111' move away from each other, or self-expand, causing the outer wall surfaces 140 of each spring members 111' to assume less of an arch, while at the same time the diameter of the expandable tubular 50"" increases.

Still with reference to FIG. 9, the expandable tubular 50"" may be alternatively constructed by assembling a plurality of individually compressed spring members 111' to form basepipe 60 in its run-in, or reduced diameter configuration 55. In either case, each of the spring members 111' are preferably associated, or in some manner secured to adjacent spring members 111' or wall members 110 (not shown), such as by a retaining mechanism, such as tack welds, chemical adhesives, an interior, expandable liner (not shown), or by epoxy or similar technique. Alternatively, expandable tubular 50"" may be formed as an integral structure formed of a generally cylindrically shaped, integrally pleated structure, wherein each of the pleats is a spring-like member, or spring member.

It should be noted that when the curved wall surfaces, or wall members 140, as well as the legs 92 of spring members 111' are compressed, care must be taken as so as to not permanently deform the legs 92 or curved wall surfaces 140 beyond their elastic limit. It will be apparent to one of ordinary skill in the art, that if the legs 92 or the curved wall surfaces 140 are deformed beyond their elastic limit, the expandable tubular 50"" possibly will not expand, or self-expand, as desired, or if it does still continue to self-expand, the expansion may not be as efficient. For example, if when the legs 92 are compressed with a force below the elastic limit of the material forming the legs, but the wall surfaces 140 are compressed, or deformed, with a force greater than the elastic limit of the material forming the curved wall members 140, it is possible that the spring members 111' will not self-expand, or alternatively will not self-expand to their fullest extent, since their movement may be restrained by the permanently deformed wall surfaces 140.

Figure 10:
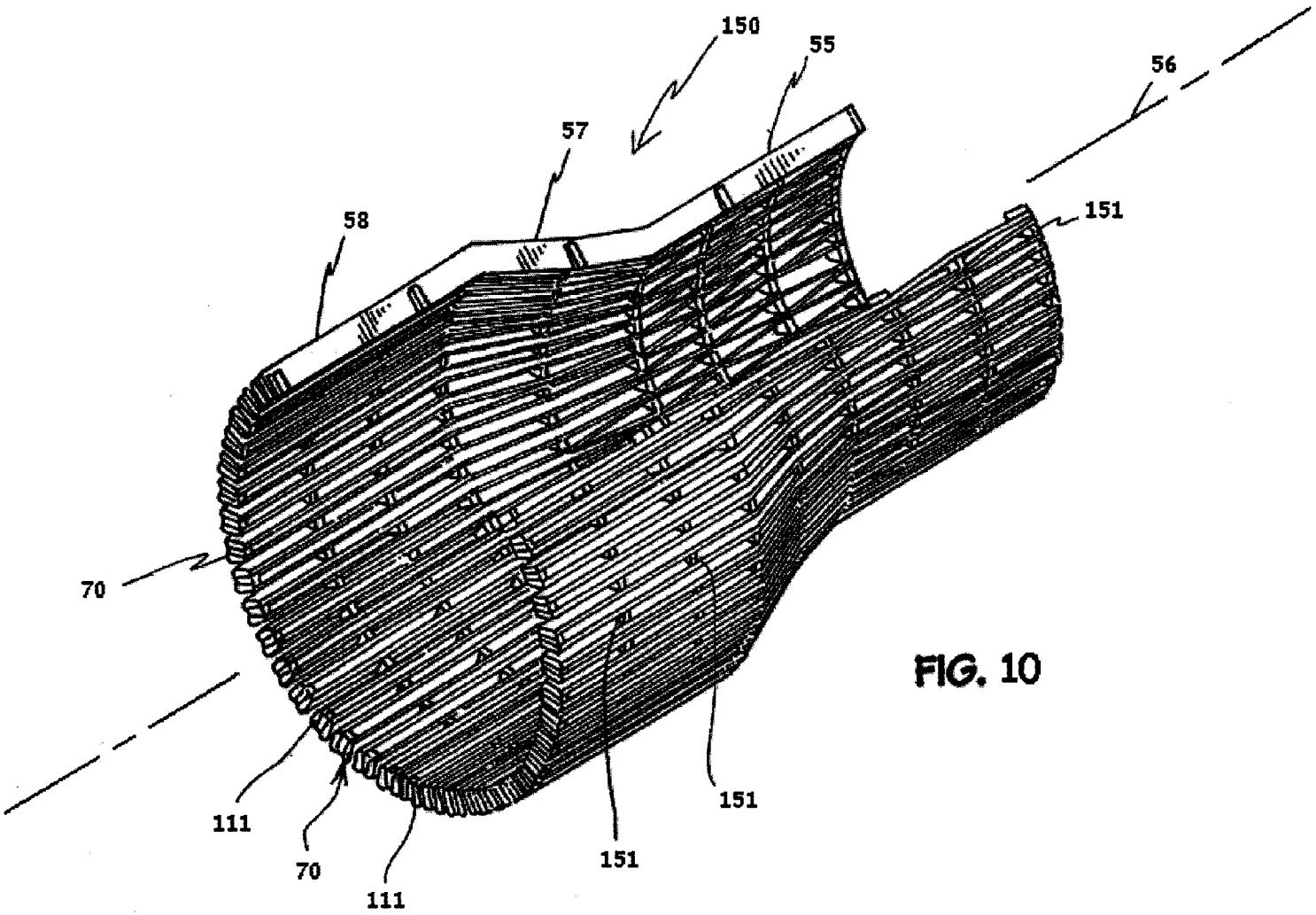
FIG. 10 is a perspective view of a sand screen in accordance with the present invention.

With reference to FIG. 10, an expandable tubular in the form of a sand screen, or well screen, 150 for use in a wellbore is shown. Sand screen 150 is similar in general construction to the sand screens of the patents incorporated by reference; however, sand screen 150 of FIG. 10 of the present invention is self-expanded, or self-expandable, in accordance with the present invention. The construction of sand screen 150 is similar to that of expandable tubular 50" of FIG. 6, and includes a plurality of energy storage components 70, radially disposed about the longitudinal axis 56 of sand screen 150. The energy storage components 70 may be in the form of elongated V-shaped or U-shaped spring members. In lieu of spring members 111' being disposed between axially extending, substantially rigid members, or wall members 110 as shown in FIG. 6, the longitudinally extending spring members 111' are disposed in a spaced relationship from adjacent spring members 111', as by a plurality of spacer members 151. Spacer members 151 provide a plurality of voids, or openings between adjacent spring members 111', whereby fluid (not shown) may flow inwardly into sand screen 150 as is known in the art. As seen in FIG. 10, as sand screen 150 expands from its reduced diameter configuration 55 to its fully expanded diameter configuration 58, the desired sand screen configuration is provided. As with the other embodiments of expandable tubulars, the sand screen 150 may be initially compressed into the desired configuration illustrated in 55 and temporarily restrained in that configuration through use of any of the techniques previously described in connection with the other embodiments. Upon the restraining force being released, as previously described, sand screen 150 expands, or self-expands, to the configuration illustrated at 58. Sand screen 150 may function as an expandable sand-screen, could serve as an overlay to another basepipe 60, or could function as a basepipe 60 which could be used with a layer of rubber or plastic material (not shown), as previously described in connection with FIGS. 2 and 7.

Figure 11:
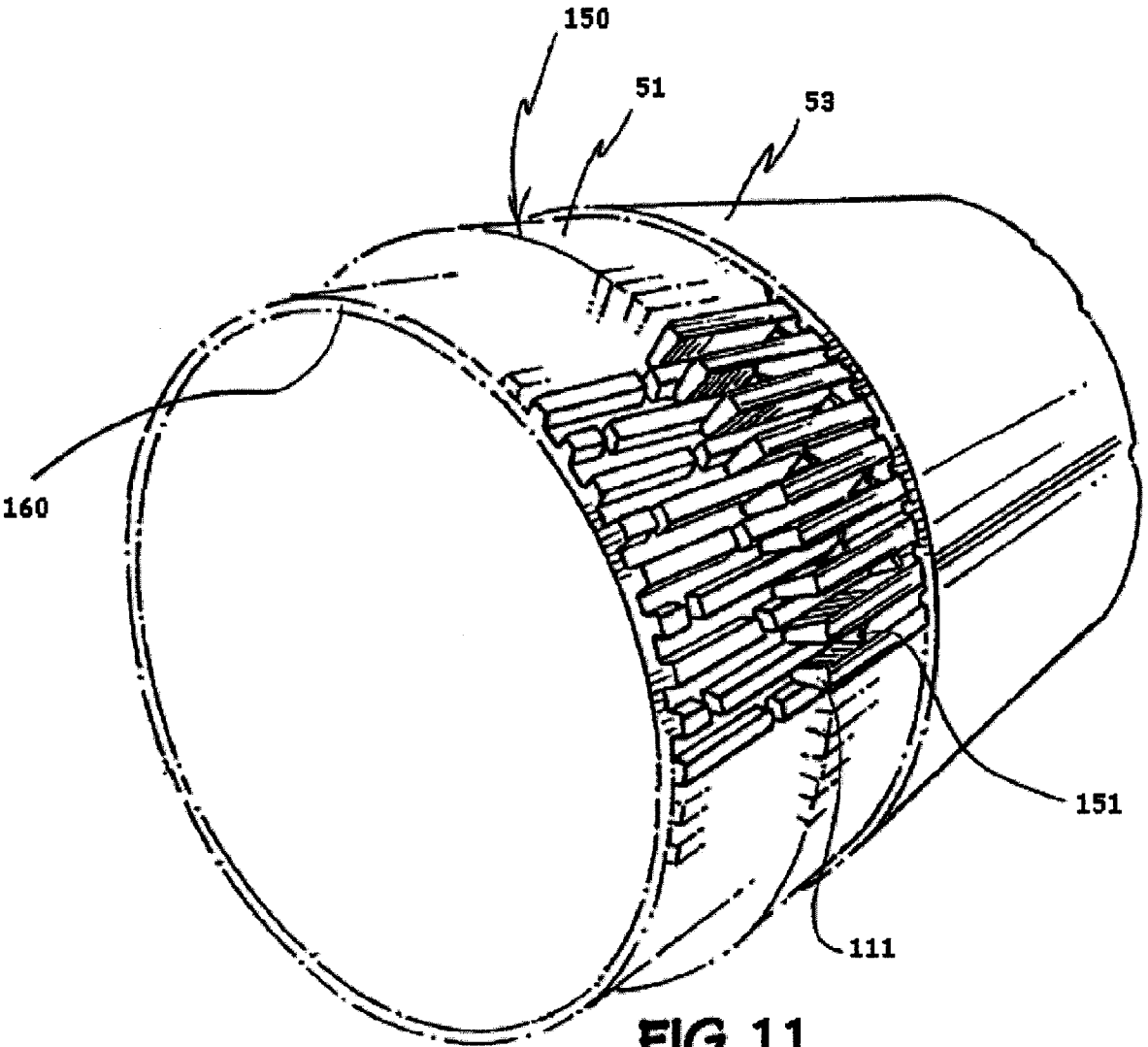
FIG. 11 is a perspective view of a sleeve in accordance with the present invention.

FIG. 11 illustrates the sand screen 150 of FIG. 10 with an elastomeric layer 53 on the outer surface 51 of sand screen 150, whereby sand screen 150 in combination with the elastomeric layer 53 may function as a self-conforming sleeve structure for use in a geologic structure. Spring members 111' may have the same construction as those shown in FIG. 10 including spacer members 151. If desired, an interior elastomeric layer 160 may also be provided. Additionally, an expandable filter layer could also be used upon the outer wall surface of the well screen, or sand control screen 150.

It should be noted that in each of the embodiments of expandable tubulars of the present invention, upon the expandable tubular or sand screen expanding outwardly into its desired expanded configuration, there is substantially no reduction in length of the expanding tubular or sand screen along its longitudinal axis. This feature of the present invention, wherein the length of each expanding tubular remains substantially the same, whether in the expanded configuration 58 or in the compressed figuration 55, is believed to result in easy and efficient connecting of lengths of expandable tubulars, as well as easy and efficient installation of the expandable tubulars in a geologic structure, such as a borehole. It is also believed that to the extent that obstructions are encountered in a geologic structure, such as a borehole, the flexible nature of the energy storage components or springs will permit the expandable tubulars of the present invention to better conform to the interior wall surface of a borehole or other geologic structure.

It is to be understood that the invention is not limited to the exact details of construction, operation, exact materials or embodiments shown and described, as obvious modifications and equivalents will be apparent to one skilled in the art. For example, a well screen, such as shown in the incorporated patents could be manufactured with: a longitudinal tensioning, or stretching, force applied and locked into, or stored in, the well screen; a radially applied compressional force applied and locked into, or stored in, the well screen; or a torsional, or twisting, force applied to, and stored in the well screen. All of these forces, or stored energy, upon being applied would initially reduce the diameter of the well screen. Upon such force or energy being released, the stored energy would provide an outwardly directed biasing force after the well screen has achieved a second, enlarged diameter. The forces applied would all be less than the elastic limit of the material being tensioned, compressed, or torqued. Accordingly, the invention is therefore to be limited only by the scope of the appended claims.

The invention claimed is:

1. An expandable tubular for use in geologic structures, comprising:

a generally tubular shaped member having a first diameter, an outer wall surface, a longitudinal axis, and at least one continuously biasing energy storage component which stores expansive energy in the tubular shaped member when the member has the first diameter; and upon the release of the expansive energy from the at least one energy storage component, the generally tubular shaped member is expandable to have a second diameter which is larger than the first diameter;

wherein the at least one energy storage component is at least one spring that forms only a portion of the outer wall surface of the generally tubular shaped member.

2. The expandable tubular of claim 1 wherein the spring is formed as a groove formed in the outer wall surface of tubular shaped member.

3. The expandable tubular of claim 1, wherein the spring is a portion of the outer wall surface having a generally serpentine or Z-shaped configuration.

4. The expandable tubular of claim 1, wherein the spring is an elongated, generally V-shaped or generally U-shaped spring member, the spring member being disposed substantially parallel to the longitudinal axis of the tubular shaped member.

5. The expandable tubular of claim 4, wherein the spring member includes an elongate curved wall surface disposed substantially parallel to the longitudinal axis of the tubular shaped member.

6. The expandable tubular of claim 5, wherein the spring member includes at least two legs, and the curved wall surface is secured to the at least two legs.

7. The expandable tubular of claim 1, further including a restraining device, which maintains the tubular shaped member in its first diameter.

8. The expandable tubular of claim 7, wherein the restraining device maintains the at least one energy storage component in a compressed state, whereby expansive energy is stored within the at least one energy storage component.

9. The expandable tubular of claim 1, further including an elastomeric layer disposed about the outer wall surface of the generally tubular shaped member.

10. The expandable tubular of claim 1, further including a filter layer disposed about the outer wall surface of the generally tubular shaped member.

11. A method for expanding an expandable tubular in a geologic structure comprising the steps of:

providing an expandable tubular having a first diameter, an outer wall surface, and a longitudinal axis, the expandable tubular further including at least one continuously biasing energy storage component that is at least one spring which stores expansive energy when the expandable tubular has the first diameter and that forms only a portion of the outer wall surface, the outer wall surface of the expandable tubular including a plurality of slots or openings;

inserting the expandable tubular into the geologic structure;

releasing the expansive energy from the at least one energy storage component, which causes the expandable tubular to have a second diameter which is larger than the first diameter after the expandable tubular is inserted into the geologic structure.

12. The method of claim 11, wherein the spring is disposed substantially parallel to the longitudinal axis of the expandable tubular.

13. The method of claim 11, further including the step of maintaining the expandable tubular with its first diameter with a restraining device.

14. The method of claim 11, further including the step of maintaining the at least one energy storage component in a compressed state, when the expandable tubular has the first diameter, to store expansive energy within the at least one energy storage component.

15. The method of claim 11, further including the step of providing the outer wall surface of the expandable tubular with an elastomeric layer when the tubular shaped member has the first diameter.

16. A method for forming an expandable tubular for use in a geologic structure, comprising the steps of:

providing a generally tubular shaped member having a first diameter;

forming at least one continuously biasing energy storage component within only a portion of an outer wall surface of the tubular member of the expandable tubular, wherein the at least one continuously biasing energy storage component is a spring and stores expansive energy; and releasing the expansive energy to expand the expandable tubular to a second diameter which is greater than the first diameter.

17. The method of claim 16, wherein the spring is disposed substantially parallel to the longitudinal axis of the expandable tubular.

18. The method of claim 16, further including the step of providing the generally tubular shaped member with a restraining device to maintain the tubular shaped member with the first diameter.

19. The method of claim 16, further including the step of maintaining the at least one energy storage component in a compressed state, when the tubular shaped member has the first diameter, to store expansive energy within the at least one energy storage component.

20. The method of claim 16, further including the step of providing the outer wall surface of the tubular shaped member with an elastomeric layer when the tubular shaped member has the first diameter.

21. The method of claim 16, wherein the outer wall surface of the tubular shaped member includes a plurality of slots or openings.

22. An expandable tubular for use in geologic structures, comprising:

at least one continuously biasing energy storage component that stores expansive energy and forms only a portion of an inner wall surface and an outer wall surface of the expandable tubular shaped member having a first diameter, and a longitudinal axis; and upon the release of the expansive energy from the at least one energy storage component, the generally tubular shaped member expands to have a second diameter which is larger than the first diameter, and the longitudinal axis does not substantially decrease in length;

wherein the at least one energy storage component is at least one spring.

23. The expandable tubular of claim 22, wherein the spring is an elongated, generally V-shaped or generally U-shaped spring member, the spring member being disposed substantially parallel to the longitudinal axis of the tubular shaped member.

24. The expandable tubular of claim 23, wherein the spring member includes an elongate curved wall surface disposed substantially parallel to the longitudinal axis of the tubular shaped member.

25. The expandable tubular of claim 24, wherein the spring member includes at least two legs, and the curved wall surface is secured to the at least two legs.

26. The expandable tubular of claim 22, further including a restraining device, which maintains the tubular shaped member in its first diameter.

27. The expandable tubular of claim 26, wherein the restraining device maintains the at least one energy storage component in a compressed state, whereby expansive energy is stored within the at least one energy storage component.

28. The expandable tubular of claim 22, further including a filter layer disposed about the outer wall surface of the generally tubular shaped member.

29. A method for expanding a an expandable tubular in a geologic structure comprising the steps of:

providing an expandable tubular having a first diameter, an inner wall surface, an outer wall surface, and a longitudinal axis, wherein only a portion of the inner wall surface and outer wall surface of the expandable tubular being formed from at least one, continuously biasing energy storage component which stores expansive energy when the expandable tubular has the first diameter;

inserting the expandable tubular into the geologic structure; and releasing the expansive energy from the at least energy storage component, which causes the expandable tubular to expand to a second diameter which is larger than the first diameter while the longitudinal axis does not substantially decrease in length;

wherein the at least one energy storage component is at least one spring.

30. The method of claim 29, wherein the spring is disposed substantially parallel to the longitudinal axis of the sand control screen.

31. The method of claim 29, further including the step of maintaining the expandable tubular with its first diameter with a restraining device.

32. The method of claim 29, further including the step of maintaining the at least one energy storage component in a compressed state, when the expandable tubular has the first diameter, to store expansive energy within the at least one energy storage component.

33. The method of claim 29, further including the step of providing upon the outer wall surface of the expandable tubular a filter layer.

* * * * *